US010596613B2

(12) United States Patent
Nishimura et al.

(10) Patent No.: US 10,596,613 B2
(45) Date of Patent: Mar. 24, 2020

(54) PRODUCING METHOD, PRODUCING APPARATUS AND PRODUCING EQUIPMENT LINE OF PRESS FORMED PRODUCT

(71) Applicant: NIPPON STEEL & SUMITOMO METAL CORPORATION, Tokyo (JP)

(72) Inventors: Ryuichi Nishimura, Kimitsu (JP); Yoshiaki Nakazawa, Takarazuka (JP); Toru Yonebayashi, Takai (JP); Koichi Sato, Tokai (JP)

(73) Assignee: NIPPON STEEL CORPORATION, Tokyo (JP)

( * ) Notice: Subject to any disclaimer, the term of this patent is extended or adjusted under 35 U.S.C. 154(b) by 340 days.

(21) Appl. No.: 15/511,743

(22) PCT Filed: Sep. 29, 2015

(86) PCT No.: PCT/JP2015/004926
§ 371 (c)(1),
(2) Date: Mar. 16, 2017

(87) PCT Pub. No.: WO2016/051765
PCT Pub. Date: Apr. 7, 2016

(65) Prior Publication Data

US 2017/0291208 A1 Oct. 12, 2017

(30) Foreign Application Priority Data

Oct. 1, 2014 (JP) ..... 2014-203319

(51) Int. Cl.
*B21D 22/26* (2006.01)
*B21D 24/06* (2006.01)
(Continued)

(52) U.S. Cl.
CPC ..... *B21D 22/26* (2013.01); *B21D 5/01* (2013.01); *B21D 22/06* (2013.01); *B21D 22/10* (2013.01);
(Continued)

(58) Field of Classification Search
CPC ..... B21D 5/0209; B21D 5/01; B21D 22/20; B21D 22/206; B21D 22/22; B21D 22/24;
(Continued)

(56) References Cited

U.S. PATENT DOCUMENTS 7,971,466 B2 * 7/2011 Yoshitome ..... B21D 22/02 72/355.2

FOREIGN PATENT DOCUMENTS

JP 08-1243 1/1996
JP 11-319963 11/1999
(Continued)

OTHER PUBLICATIONS

JP 2004154786 A EPO Machine Translation (Year: 2019).*

*Primary Examiner* — Pradeep C Battula
(74) *Attorney, Agent, or Firm* — Clark & Brody

(57) ABSTRACT

A producing method of the press formed product includes a preparation step of preparing a metal sheet as a starting material; and a press working step of performing press working on the starting material. The press working step includes: during a time period from when pushing-in of the starting material into the die by the punch is started or immediately thereafter until the pushing-in of the punch with respect to the die reaches a predetermined distance short of a bottom dead point for the pushing-in, holding the pad at a position distant from the punch by the predetermined distance; when the pushing-in of the punch with respect to the die reaches the predetermined distance short of the bottom dead point, receiving the pad in the die; and
(Continued)

continuing the pushing-in of the punch with respect to the die and the pad to the bottom dead point.

5 Claims, 9 Drawing Sheets

(51) Int. Cl.

| | |
|---|---|
| ***B21D 22/10*** | (2006.01) |
| ***B21D 5/01*** | (2006.01) |
| ***B21D 24/00*** | (2006.01) |
| ***B21D 22/06*** | (2006.01) |
| ***B21D 47/01*** | (2006.01) |

(52) U.S. Cl.
CPC ..... *B21D 24/00* (2013.01); *B21D 24/06* (2013.01); *B21D 47/01* (2013.01)

(58) Field of Classification Search
CPC ..... B21D 22/26; B21D 22/28; B21D 22/30; B21D 19/02; B21D 19/08; B21D 19/10; B21D 22/02
See application file for complete search history.

(56) References Cited

FOREIGN PATENT DOCUMENTS

| | | |
|---|---|---|
| JP | 2004-154786 | 6/2004 |
| JP | 2008-189126 | 8/2008 |
| JP | 2009-113797 | 5/2009 |
| JP | 2009-248585 | 10/2009 |
| JP | 2009-255116 | 11/2009 |
| JP | 2011-195103 | 10/2011 |
| JP | 2013-018026 | 1/2013 |
| JP | 2013-202665 | 10/2013 |
| JP | 2014-141181 | 8/2014 |
| WO | 2014/042067 | 3/2014 |
| WO | 2014/208181 | 12/2014 |

* cited by examiner

PRODUCING METHOD, PRODUCING APPARATUS AND PRODUCING EQUIPMENT LINE OF PRESS FORMED PRODUCT

TECHNICAL FIELD

The present invention relates to a method, an apparatus and an equipment line for producing a press formed product used in automobiles, various vehicles other than automobiles, home appliances, vessels, architectural materials, etc.

BACKGROUND ART

For example, the car body of an automobile includes various structural members (examples: floor cross members, side sills, side members, etc.). Press formed products, which use metal sheets such as steel sheets as their starting materials, are heavily used in the structural members. Due to the advantages over material rupture, shape fixability, and producing cost at the time of press forming, in many cases, a press formed product is obtained by performing press working on a metal sheet through bending forming. The press formed product has, for example, a channel cross-section shape or a hat-shaped cross-section shape. The press formed product having a channel cross-section includes a top panel part and a pair of vertical wall parts extending from the top panel part. The press formed product having a hat-shaped cross-section further includes a pair of flange parts extending from the respective vertical wall parts.

FIG. 1 is a cross-sectional view schematically showing a configuration example of a press forming apparatus that performs general bending forming. As shown in FIG. 1, a press forming apparatus 1 is an apparatus for producing a press formed product having a channel cross-section or a hat-shaped cross-section. FIG. 1 illustrates the case of producing a press formed product having a hat-shaped cross-section (see a dashed line in FIG. 1). The press forming apparatus 1 includes a punch 2 as a lower die, and includes a die 3 and a pad 5 as an upper die. The pad 5 is supported by the die 3 or by a die holder or slider integrally operated with the die 3 via a pressure member 4. The pad 5 can be received in the die 3, and constitutes a part of the die 3 with being received in the die 3.

The bending forming of forming a metal sheet 6 into a press formed product by such press forming apparatus 1 is performed as follows. Before the forming, the metal sheet 6 is sandwiched between the punch 2 and the pad 5. That is, before staring the pushing-in of the metal sheet 6 into the die 3 by the punch 2, a portion of the metal sheet 6, which portion is formed into a top panel part of the press formed product, is restrained by the punch 2 and the pad 5. In this state, the die 3 is descended to a bottom dead point. In this manner, the top panel part of the press formed product is formed along a top surface (a front end surface) 2*a* of the punch 2. Vertical wall parts are formed along side surfaces 2*b* of the punch 2. Ridge line parts are formed between the top panel part and the vertical wall parts. The ridge line parts connecting the top panel part to the vertical wall parts are formed along punch shoulder parts 2*c* of the punch 2. Hereinafter, such bending forming is referred to as the pad bending forming.

In these years, it is required for automobiles to save the car body weight, so as to improve the fuel economy, which contributes to prevention of global warming. Further, the improvement of the safety at the time of collision accident is required. Because of these requirements, a high-strength steel sheet having a tensile strength of 590 MPa or more is used as the metal sheet 6, which is the starting material of the structural member. For example, a 980 MPa-class high-strength steel sheet is also used, and in some cases, a 1180 MPa-class high-strength steel sheet is used.

Additionally, the shapes of the structural members may become relatively complex. This is because of the design constraints, such as prevention of the interference between the structural members and the other members, bonding between the structural members and the other members, securing of a desired space, etc.

FIGS. 2A and 2B and FIGS. 3 to 8 are perspective views showing examples of press formed products having relatively complex shapes. Among these figures, FIGS. 2A and 2B show a first exemplary press formed product 7 formed from a high-strength steel sheet having a tensile strength of 590 MPa or more (an alloyed hot-dip galvanized steel sheet made of DP (Dual Phase) steel having a sheet thickness of 1.2 mm). FIG. 2A shows the entire first exemplary press formed product 7, and FIG. 2B shows a portion A in FIG. 2A in an enlarged manner. Additionally, FIGS. 3 to 8 show second to seventh exemplary press formed products 7 formed from a high-strength steel sheet having a tensile strength of 590 MPa or more (an alloyed hot-dip galvanized steel sheet, a non-plated steel sheet, etc. having a sheet thickness of about 1.2 mm), respectively.

Each of the cross-section shapes of the first to seventh exemplary press formed products 7 is a hat shape. That is, each of the press formed products 7 includes a top panel part 7*a*, vertical wall parts 7*c* extending from the left and right ends of the top panel part 7*a*, ridge line parts 7*b* between the top panel part 7*a* and the vertical wall parts 7*c*, and flange parts 7*d* extending from the lower ends of the respective vertical wall parts 7*c*. Further, the press formed product 7 includes shape-changing parts 9 in parts of the ridge line parts 7*b*.

In the first exemplary press formed product 7 shown in FIGS. 2A and 2B, the shape-changing parts 9 are provided in both of the ridge line parts 7*b* on both ends of the top panel part 7*a*. In these shape-changing parts 9, the height of the ridge line parts 7*b* is changed at local portions located in almost middle of the lengthwise direction of the press formed product 7. In this case, a step height part 8 is formed in the top panel part 7*a* in a region connecting the shape-changing parts 9 to each other.

In the second exemplary press formed product 7 shown in FIG. 3, the shape-changing parts 9 are provided in both of the ridge line parts 7*b* on both ends of the top panel part 7*a*. In these shape-changing parts 9, the height of the ridge line parts 7*b* is changed in a wide area almost in the middle of the lengthwise direction of the press formed product 7. In this case, the height of the top panel part 7*a* gently changes corresponding to the positions of the shape-changing parts 9.

In the third exemplary press formed product 7 shown in FIG. 4, the shape-changing part 9 is provided in one of the ridge line parts 7*b* on both ends of the top panel part 7*a*. This shape-changing part 9 change the arc length in a cross section of the ridge line part 7*b* at a local portion almost in the middle of the lengthwise direction of the press formed product 7. In this case, the angle between the top panel part 7*a* and the vertical wall part 7*c* changes corresponding to the position of the shape-changing part 9.

In the fourth exemplary press formed product 7 shown in FIG. 5, the shape-changing parts 9 are provided in both of the ridge line parts 7*b* on both ends of the top panel part 7*a*. In these shape-changing parts 9, the ridge line parts 7*b* are twisted in a wide area almost in the middle of the lengthwise direction of the press formed product 7. In this case, the top panel part 7*a* and the vertical wall parts 7*c* are twisted corresponding to the positions of the shape-changing parts 9.

In the fifth exemplary press formed product 7 shown in FIG. 6, the shape-changing parts 9 are provided in both of the ridge line parts 7*b* on both ends of the top panel part 7*a*. In these shape-changing parts 9, the ridge line parts 7*b* are warped in the width direction of the press formed product 7 in a wide area almost in the middle of the lengthwise direction of the press formed product 7. In this case, the top panel part 7*a* and the vertical wall parts 7*c* are warped in the width direction of the press formed product 7 corresponding to the positions of the shape-changing parts 9.

In the sixth exemplary press formed product 7 shown in FIG. 7, the shape-changing part 9 is provided in one of the ridge line parts 7*b* on both ends of the top panel part 7*a*. In the shape-changing part 9, this ridge line part 7*b* is hollowed in the width direction of the press formed product 7 at a local portion almost in the middle of the lengthwise direction of the press formed product 7. In this case, the top panel part 7*a* and the vertical wall parts 7*c* are hollowed in the width direction of the press formed product 7 corresponding to the position of the shape-changing part 9.

In the seventh exemplary press formed product 7 shown in FIG. 8, the shape-changing part 9 is provided in one of the ridge line parts 7*b* on both ends of the top panel part 7*a*. In this shape-changing part 9, the radius of curvature of a cross section of the ridge line part is changed in an area from almost the middle to one end of the lengthwise direction of the press formed product 7. In this case, the width of the top panel part 7*a* and the height of the vertical wall part 7*c* are changed corresponding to the position of the shape-changing part 9.

When cold producing the first exemplary press formed product 7 shown in FIG. 2A from a high-strength steel sheet by the pad bending forming shown in FIG. 1, the following problems occur. As indicated by bold lines in FIG. 2B, in the press formed product 7, cracks occur in the region of the shape-changing part 9 of the ridge line part 7*b*. These cracks also occur in the region in the vicinity of the shape-changing part 9 (the step height part 8, the top panel part 7*a*, etc.). At the time of the pad bending forming, the ridge line part 7*b* is subjected to bending stress in the direction perpendicular to the direction along the ridge line part 7*b*. Further, the shape-changing part 9 in the ridge line part 7*b* is subjected to tensile stress in the direction along the ridge line part 7*b*. That is, the shape-changing part 9 is subjected to both of these bending stress and tensile stress. Therefore, tensile and bending deformation occurs in the region of the shape-changing part 9 and in the region in the vicinity thereof. It is considered that the cracks occur in the region of the shape-changing part 9 due to this tensile and bending deformation.

Such cracks may similarly occur even in the second to seventh exemplary press formed products press formed product 7 shown in FIGS. 3 to 8.

Aiming to suppress the occurrence of such cracks reduces the degree of freedom in designing the structural members. This is because the various dimensions of the shape-changing parts 9 in the ridge line parts 7*b* are restricted in accordance with the press formability of a high-strength steel sheet, which is a starting material.

The prior arts for preventing the occurrence of cracks in press formed products are disclosed in, for example, International Application Publication No. WO2014/042067 (Patent Literature 1) and Japanese Patent Application Publication No. 11-319963 (Patent Literature 2).

CITATION LIST

Patent Literature

Patent Literature 1: International Application Publication No. WO2014/042067

Patent Literature 2: Japanese Patent Application Publication No. 11-319963

SUMMARY OF INVENTION

Technical Problem

Patent Literature 1 is directed to producing of a press formed product whose cross-section shape is a hat-shape and that is curved in the height direction, and discloses the technique for preventing cracks in a top panel part or the like of a convex curved part in the press formed product. However, the press forming according to this technique is the draw forming using a blank holder. In the draw forming, the tensile stress is generated in the direction perpendicular to the direction along a ridge line part. Therefore, in a press formed product having a shape-changing part in a part of the ridge line part, the tensile stress generated in the shape-changing part is increased, and it is impossible to suppress the occurrence of cracks.

Additionally, according to the technique disclosed in Patent Literature 2, there is a possibility to reduce the occurrence of cracks. However, in this technique, prior to the press forming, a compression process is performed on a starting material. Therefore, additional step and equipment are required, and an increase in the producing cost cannot be avoided.

As described above, in the prior arts, it is impossible to reduce the occurrence of cracks in the region of a shape-changing part, when forming, from a high-strength steel sheet having a tensile strength of 590 MPa or more, for example, a press formed product having the shape-changing part in a part of the ridge line part.

Additionally, when a press formed product having a hat-shaped cross-section is formed by the simple pad bending forming, vertical wall parts tend to warp outwardly due to springback.

An object of the present invention is to provide a producing method of a press formed product, a producing apparatus thereof, and a producing equipment line thereof that can reduce the occurrence of cracks in the region of a shape-changing part, even in the case where, for example, a high-strength steel sheet is used as a starting material, when forming the press formed product having a channel cross-section or a hat-shaped cross-section including the shape-changing part in a part of a ridge line part. Additionally, another object of the present invention is to provide a producing method of a press formed product and a producing equipment line thereof that can reduce the occurrence of warping of vertical wall parts, even in the case where, for example, a high-strength steel sheet is used as a starting material, when forming the press formed product having a hat-shaped cross-section including a shape-changing part in a part of a ridge line part.

Solution to Problem (1) A producing method according to an embodiment of the present invention is a method for producing a press formed product from a starting material.

The press formed product includes a top panel part, vertical wall parts respectively extending from both ends of the top panel part, and ridge line parts between the vertical wall parts and the top panel part, and includes a shape-changing part in a part of the ridge line parts.

The producing method includes:

a preparation step of preparing a metal sheet as the starting material; and a press working step of performing press working on the starting material by using a punch, a pad arranged opposed to a front end surface of the punch, and a die capable of receiving the pad.

The press working step includes:

during a time period from when pushing-in of the starting material into the die by the punch is started or immediately thereafter until the pushing-in of the punch with respect to the die reaches a predetermined distance short of a bottom dead point for the pushing-in, holding the pad at a position distant from the punch by the predetermined distance;

when the pushing-in of the punch with respect to the die reaches the predetermined distance short of the bottom dead point, receiving the pad in the die; and continuing the pushing-in of the punch with respect to the die and the pad to the bottom dead point, so as to form the top panel part, the ridge line parts, and the vertical wall parts.

In the producing method of the above-described (1), the predetermined distance is preferably 3 mm to 30 mm.

(2) The producing method of the above-described (1) can employ the following configuration.

In the press working step, the top panel part and the ridge line parts are formed, and predetermined regions, having a predetermined height from the top panel part, of regions formed into the vertical wall parts are also formed.

The producing method further includes a second press working step of performing press working on an intermediate formed product obtained in the press working step.

In the second press working step, the vertical wall parts are formed from excessive regions of the regions formed into the vertical wall parts except for the predetermined regions.

When the press formed product further includes flange parts extending from ends of the respective vertical wall parts, the producing method of the above-described (2) can employ the following configuration.

The second press working step uses a main second punch, a sub second punch arranged adjacent to the main second punch, a second pad arranged opposed to a front end surface of the main second punch, and a second die capable of receiving the second pad.

The second press working step includes:

a step of starting pushing-in of the intermediate formed product into the second die by the main second punch, with the top panel part of the intermediate formed product being sandwiched between the main second punch and the second pad;

a step of continuing the pushing-in of the main second punch with respect to the second die until a bottom dead point for the pushing-in, so as to receive the second pad in the second die, and to form the vertical wall parts from the excessive regions of the intermediate formed product; and a step of starting the pushing-in of the sub second punch with respect to the second die and the second pad, and continuing the pushing-in of the sub second punch until a bottom dead point for the pushing-in, so as to form the flange parts from the excessive regions of the intermediate formed product.

(3) The producing method according to an embodiment of the present invention is a method for producing a press formed product from a starting material.

The press formed product includes a top panel part, vertical wall parts respectively extending from both ends of the top panel part, ridge line parts between the vertical wall parts and the top panel part, and flange parts extending from ends of the respective vertical wall parts, and includes a shape-changing part in a part of the ridge line parts.

The producing method includes:

a preparation step of preparing a metal sheet as the starting material; and a press working step of performing press working on the starting material.

The press working step uses a main punch, a sub punch arranged adjacent to the main punch, a pad arranged opposed to a front end surface of the main punch, and a die capable of receiving the pad. The press working step includes:

a step of starting pushing-in of the starting material into the die by the main punch, with the starting material being sandwiched between the main punch and the pad;

a step of continuing the pushing-in of the main punch with respect to the die until a bottom dead point for the pushing-in, so as to receive the pad in the die, and to form the top panel part, the ridge line parts, and the vertical wall parts; and a step of starting pushing-in of the sub punch with respect to the die and the pad, and continuing the pushing-in of the sub punch until a bottom dead point for the pushing-in, so as to form the flange parts.

(4) The producing method of the above-described (3) can employ the following configuration.

The producing method includes:

prior to the press working step, a preliminary press working step of performing press working on the metal sheet prepared in the preparation step, so as to obtain an intermediate formed product as the starting material.

In the preliminary press working step, the top panel part and the ridge line parts are formed, and predetermined regions, having a predetermined height from the top panel part, of regions formed into the vertical wall parts are formed as the intermediate formed product.

In the press working step, pushing-in of the intermediate formed product into the die by the main punch is started, with the top panel part of the intermediate formed product being sandwiched between the main punch and the pad.

Thereafter, the pushing-in of the main punch with respect to the die is continued until a bottom dead point for the pushing-in, so as to receive the pad in the die, and to form the vertical wall parts from excessive regions of the regions formed into the vertical wall parts except for the predetermined regions.

Thereafter, pushing-in of the sub punch with respect to the die and the pad is started, and the pushing-in of the sub punch is continued until a bottom dead point for the pushing-in, so as to form the flange parts from the excessive regions of the intermediate formed part.

The producing method of the above-described (2) or (4) preferably employs the following configuration.

The predetermined height h (mm) satisfies the condition of a Formula (1) as follows:

$$Rp \leq h \leq H - Rp \quad (1)$$

where, in the Formula (1), H represents the height (mm) of the press formed product, and Rp represents the radius of curvature (mm) in a cross section of the ridge line part.

The above-described producing method can employ the following configuration.

The shape-changing part of the ridge line part is at least one of (a) to (f) as follows:

(a) the height of the ridge line part is changed;

(b) the arc length in the cross section of the ridge line part is changed;

(c) the ridge line part is twisted;

(d) the ridge line part is bent in the width direction;

(e) the ridge line part protrudes or is hollowed in the width direction; and (f) the radius of curvature in the cross section of the ridge line part is changed.

(5) A producing apparatus according to an embodiment of the present invention is an apparatus for producing a press formed product from a starting material.

The press formed product includes a top panel part, vertical wall parts respectively extending from both ends of the top panel part, and ridge line parts between the vertical wall parts and the top panel part, and includes a shape-changing part in a part of the ridge line parts.

The producing apparatus includes:

a punch including a front end surface corresponding to the top panel part, side surfaces corresponding to the vertical wall parts, and punch shoulder parts corresponding to the ridge line parts;

a pad arranged opposed to the front end surface of the punch;

a die capable of receiving the pad; and a pad adjusting mechanism adjusting a distance from the front end surface of the punch to the pad.

(6) A producing apparatus of a press formed product according to an embodiment of the present invention includes a punch, a pad, a die, and a pad adjusting mechanism.

The punch includes a front end surface, side surfaces, and punch shoulder parts provided between the front end surface and the side surfaces, and includes a shape-changing part in a part of an extending direction of the punch shoulder part, the shape-changing part changing a shape.

The pad is arranged opposed to the front end surface of the punch, at least in a cross section perpendicular to the extending direction of the punch shoulder part in the shape-changing part.

The die includes a concave part capable of receiving the pad in a surface opposed to the front end surface of the punch, and corner parts whose portions opposing to the punch shoulder parts having shapes conforming to shapes of the punch shoulder parts.

The pad adjusting mechanism adjusts an interval between the front end surface of the punch and the pad.

(7) The producing apparatus of the above-described (5) can employ the following configuration.

The pad adjusting mechanism holds the pad at a position distant from the punch by a predetermined distance, during a time period from when pushing-in of the starting material into the die by the punch is started or immediately thereafter until the pushing-in of the punch with respect to the die reaches the predetermined distance short of a bottom dead point for the pushing-in, and receives the pad in the die, when the pushing-in of the punch with respect to the die reaches the predetermined distance short of the bottom dead point.

In the producing apparatus of the above-described (7), the predetermined distance is preferably 3 mm to 30 mm.

(8) A producing equipment line according to an embodiment of the present invention is an equipment line for producing a press formed product from a starting material.

The press formed product includes a top panel part, vertical wall parts respectively extending from both ends of the top panel part, ridge line parts between the vertical wall parts and the top panel part, and flange parts extending from ends of the respective vertical wall parts, and includes a shape-changing part in a part of the ridge line parts.

The producing equipment line includes the producing apparatus of any one of the above-described (5) to (7), and a second producing apparatus performing press working on an intermediate formed product obtained by the producing apparatus.

The intermediate formed product is a product in which regions, having a predetermined height from the top panel part, of regions of the vertical wall parts are formed.

The second producing apparatus includes:

a main second punch including a front end surface corresponding to the top panel part, side surfaces corresponding to the vertical wall parts, punch shoulder parts corresponding to the ridge line parts, and corner parts corresponding to the ridge line parts between the vertical wall parts and the flange parts;

a sub second punch arranged adjacent to the main second punch, and including front end surfaces corresponding to the flange parts;

a second pad arranged opposed to the front end surface of the main second punch;

a second die including die shoulder parts corresponding to the ridge line parts between the vertical wall parts and the flange parts, and front end surfaces corresponding to the flange parts, the second die being capable of receiving the second pad; and a sub punch adjusting mechanism delaying pushing-in of the intermediate formed product into the second die by the sub second punch than pushing-in of the intermediate formed product into the second die by the main second punch.

The producing equipment line of the above-described (8) preferably employs the following configuration.

The sub punch adjusting mechanism starts the pushing-in of the sub second punch with respect to the second die, after the pushing-in of the main second punch with respect to the second die reaches a bottom dead point.

The producing equipment line of the above-described (8) preferably employs the following configuration.

The die of the producing apparatus is formed such that the predetermined height h (mm) satisfies the condition of a Formula (1) as follows:

$$Rp \leq h \leq H - Rp \quad (1)$$

where, in the Formula (1), H represents the height (mm) of the press formed product, and Rp represents the radius of curvature (mm) in a cross section of the ridge line part.

Advantageous Effects of Invention

According to the present invention, it is possible to reduce the occurrence of cracks in the region of the shape-changing part, even in the case where, for example, a high-strength steel sheet is used as the starting material, when forming the press formed product having a channel cross-section or a hat-shaped cross-section including the shape-changing part in a part of the ridge line part. Additionally, it is possible to reduce the occurrence of warping of the vertical wall parts when forming a press formed product having a hat-shaped cross-section.

DESCRIPTION OF EMBODIMENTS

As a result of a great deal of considerations for solving the above-described objects, the inventors have obtained the findings (A) and (B).

(A) When forming, by the pad bending forming, a press formed product having a channel cross-section or a hat-shaped cross-section including a shape-changing part in a part of a ridge line part, a portion of a material metal sheet, which portion is formed into a top panel part, is restrained by a punch and a pad from beginning to end. On this occasion, both bending stress and tensile stress are applied to the shape-changing part. Therefore, the region of the shape-changing part and the region in the vicinity thereof are tensile-bending-deformed. Consequently, an excessive deformation/strain tends to occur in the region of the shape-changing part and the region in the vicinity thereof. This excessive deformation/strain causes cracks.

Accordingly, it can be said that the occurrence of cracks can be reduced by suppressing the excessive deformation/strain by alleviating tensile bending deformation in the shape-changing part. In order to do so, the restraining of the material metal sheet by the punch and the pad may be alleviated during the forming.

(B) When forming a press formed product having a hat-shaped cross-section by the pad bending forming, the forming of the top panel part, the vertical wall parts and the flange parts is simultaneously completed. In this case, due to springback, the vertical wall parts tend to warp outwardly. In order to reduce this warping of the vertical wall parts, the forming of the flange parts may be performed lastly.

The present invention has been completed on the basis of the above-described findings. Hereinafter, a description will be given of embodiments of the present invention with reference to the drawings.

First Embodiment

Figure 9:
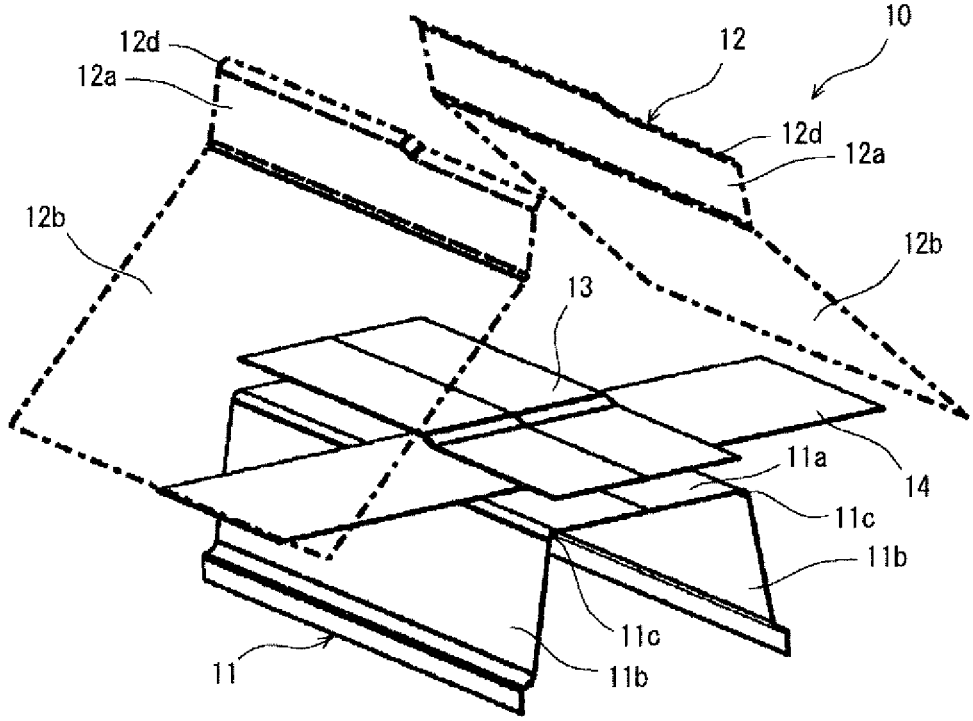
FIG. 9 is a perspective view showing an example of the structure of a first producing apparatus used in producing a press formed product according to a first embodiment of the present invention.
Figure 10:
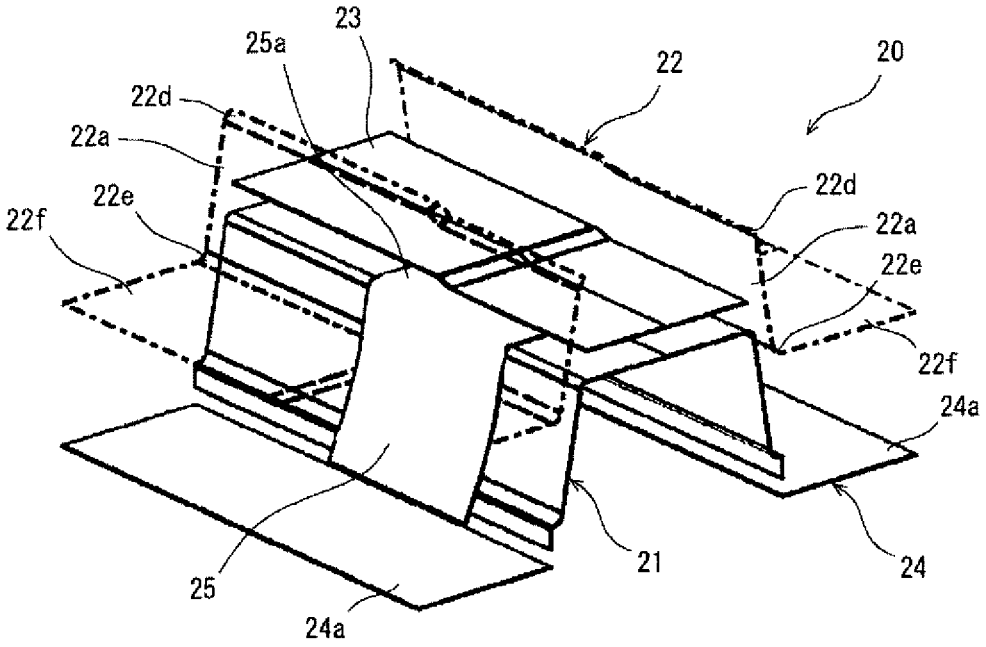
FIG. 10 is a perspective view showing an example of the structure of a second producing apparatus used in producing the press formed product according to the first embodiment of the present invention.

FIG. 9 is a perspective view showing an example of the structure of a first producing apparatus used in producing a press formed product in a first embodiment of the present invention. FIG. 10 is a perspective view showing an example of the structure of a second producing apparatus used in producing the press formed product in the first embodiment of the present invention. In the first embodiment, the case is illustrated where the first exemplary press formed product 7, having the hat-shaped cross-section shown in the above-described FIG. 2, is produced. In the first embodiment, the press formed product is produced sequentially through a first press working step and a second press working step. In the first press working step, a first press forming apparatus 10 (the first producing apparatus) shown in FIG. 9 is used. In the second press working step, a second press forming apparatus 20 (the second producing apparatus) shown in FIG. 10 is used. That is, the first press forming apparatus 10 and the second press forming apparatus 20 constitute a series of producing equipment lines.

Figure 11A:
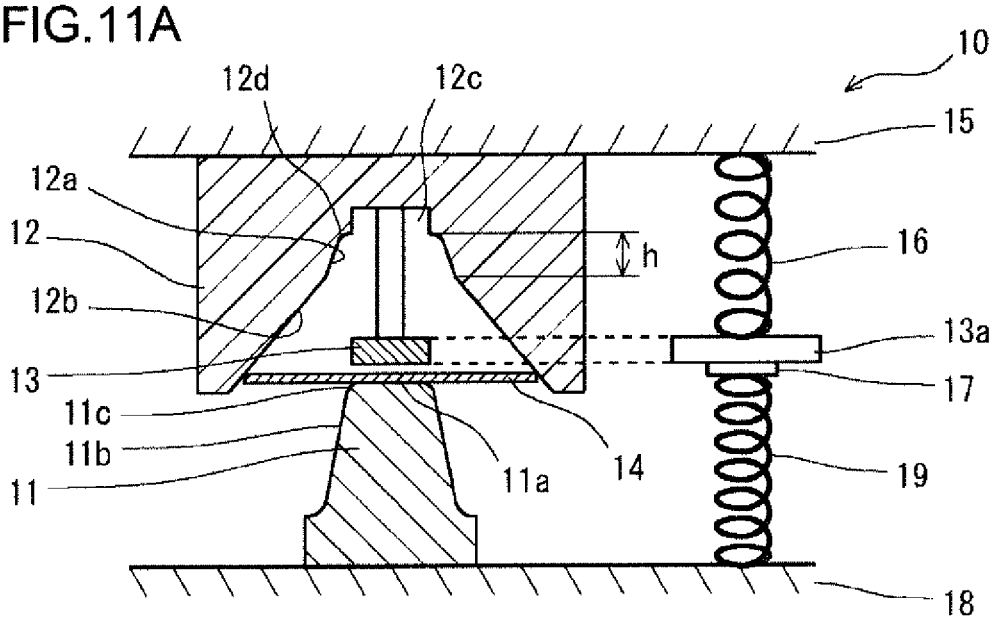
FIG. 11A is a diagram showing the status of a first press working step by the first producing apparatus in the first embodiment, and showing the state before starting the forming.
Figure 11B:
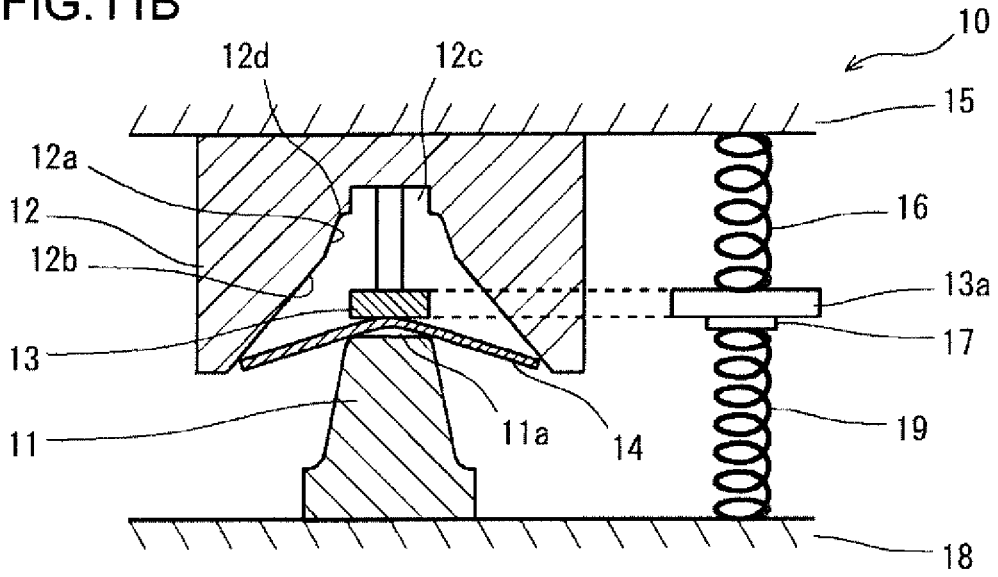
FIG. 11B is a diagram showing the status of the first press working step by the first producing apparatus in the first embodiment, and showing the state of the early phase of the forming.
Figure 11C:
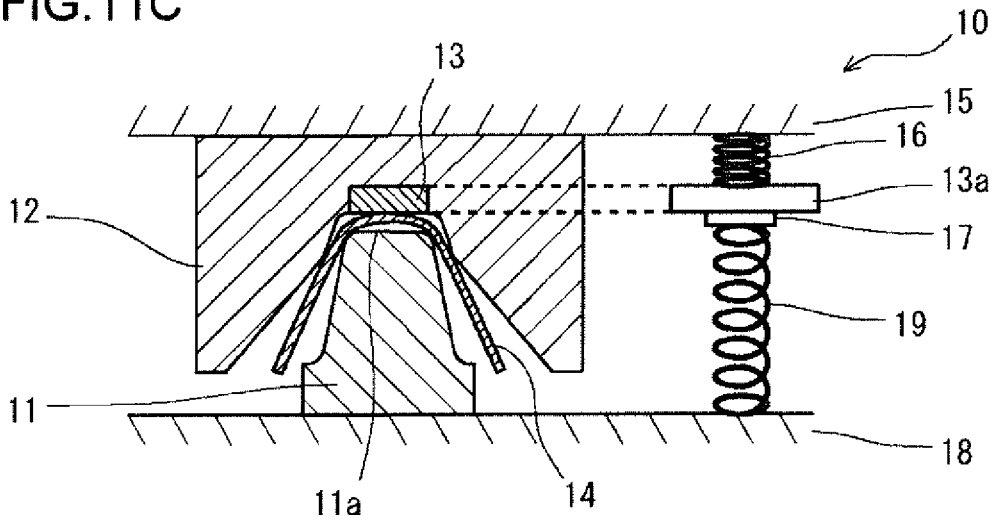
FIG. 11C is a diagram showing the status of the first press working step by the first producing apparatus in the first embodiment, and showing the state of the end phase of the forming.
Figure 11D:
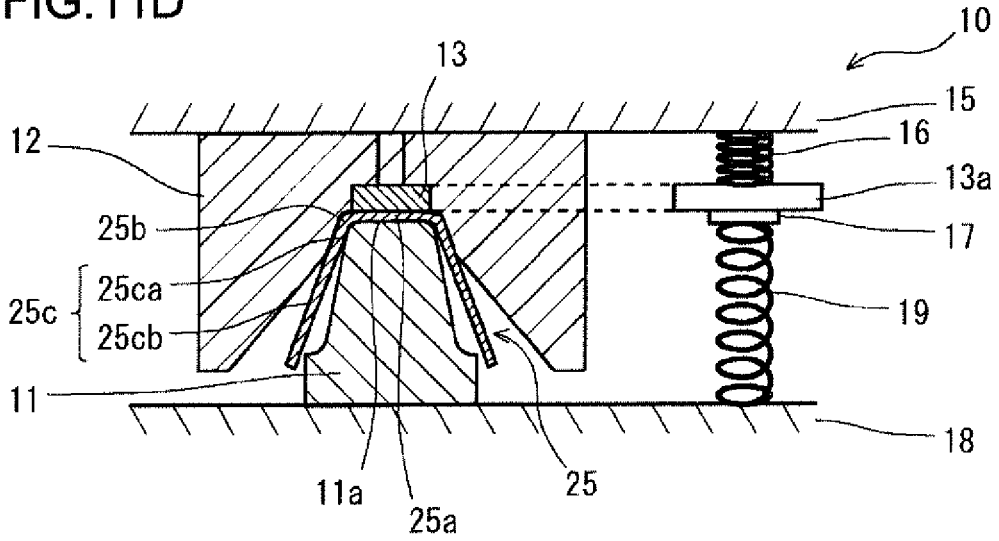
FIG. 11D is a diagram showing the status of the first press working step by the first producing apparatus in the first embodiment, and showing the state at the completion of the forming.
Figure 12A:
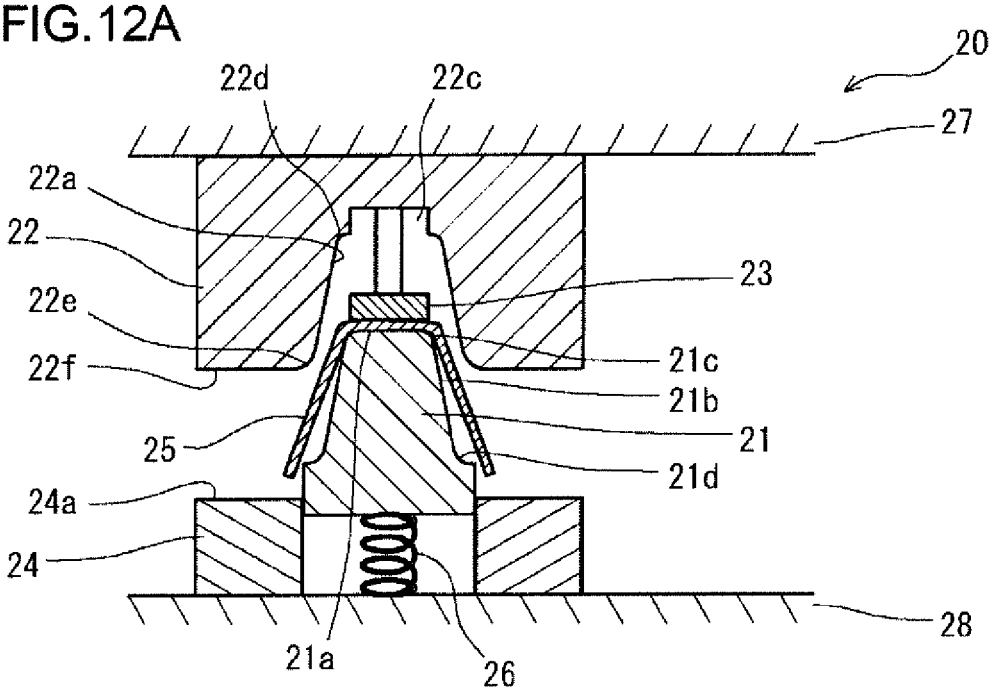
FIG. 12A is a diagram showing the status of a second press working step by the second producing apparatus in the first embodiment, and showing the state before starting the forming.
Figure 12B:
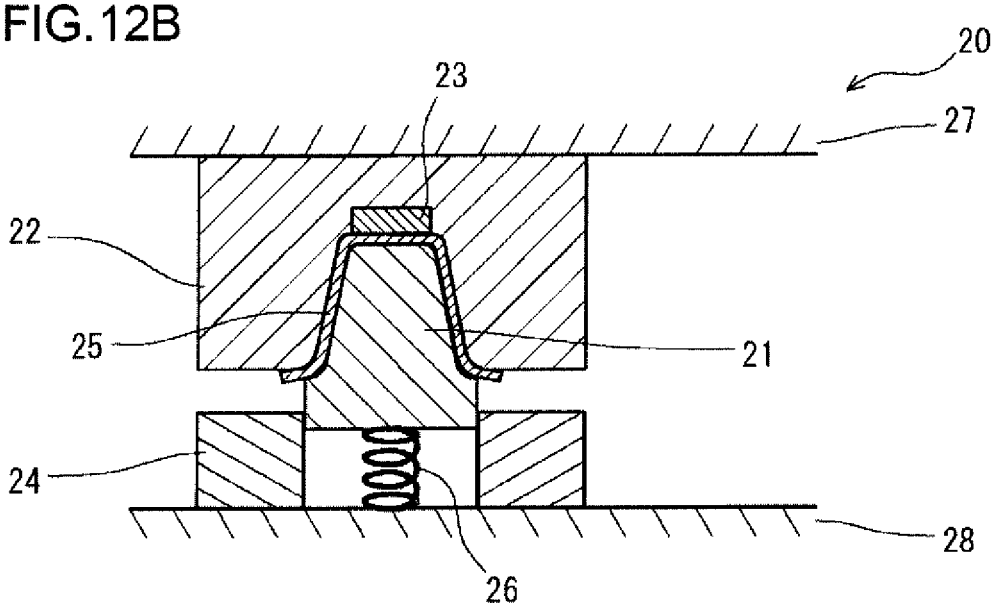
FIG. 12B is a diagram showing the status of the second press working step by the second producing apparatus in the first embodiment, and showing the state of the end phase of the forming.
Figure 12C:
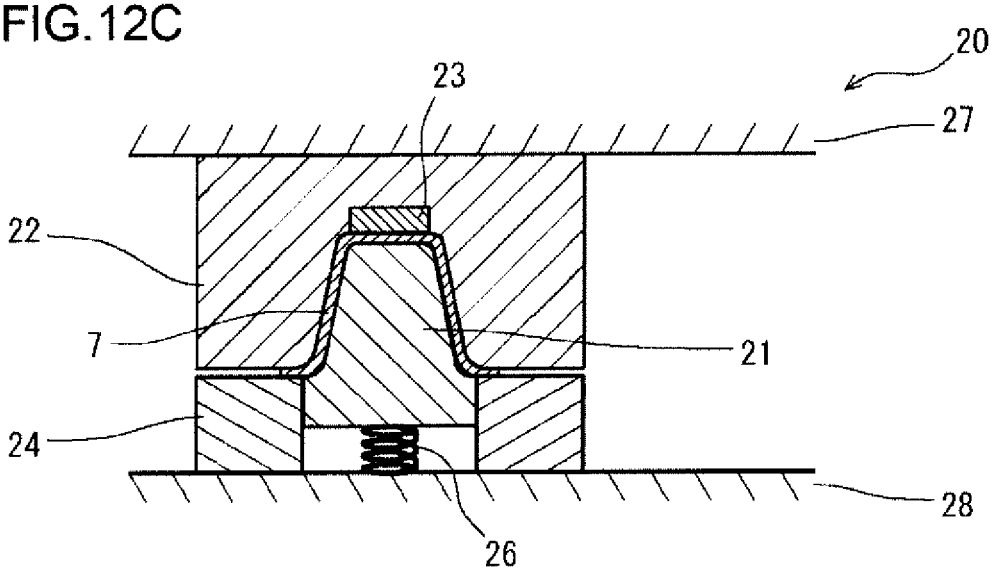
FIG. 12C is a diagram showing the status of the second press working step by the second producing apparatus in the first embodiment, and showing the state at the completion of the forming.

FIGS. 11A to 11D are diagrams showing the statuses of the first press working step by the first producing apparatus in the first embodiment. In these figures, FIG. 11A shows the state before starting the forming. FIG. 11B shows the state of the early phase of the forming. FIG. 11C shows the state of the end phase of the forming. FIG. 11D shows the state at the completion of the forming. FIGS. 12A to 12C are diagrams showing the statuses of the second press working step by the second producing apparatus in the first embodiment. In these figures, FIG. 12A shows the state before starting the forming. FIG. 12B shows the state of the end phase of the forming. FIG. 12C shows the state at the completion of the forming. These figures show the cross sections of the region of the shape-changing part.

[First Producing Apparatus]

As shown in FIG. 9 and FIGS. 11A to 11D, the first press forming apparatus 10 includes a first punch 11 as a lower die, and includes a first die 12 and a first pad 13 as an upper die. That is, the first punch 11 makes a pair with the first die 12 and the first pad 13. Note that FIG. 9 shows the first die 12 by a dashed line, so as to facilitate the understanding of the structure.

The first punch 11 includes a top surface 11*a* (a front end surface), a pair of side surfaces 11*b*, and punch shoulder parts 11*c* provided between the top surface 11*a* and the side surfaces 11*b*. The punch shoulder parts 11*c* are regions connecting the top surface 11*a* to the side surfaces 11*b*. The shape of the top surface 11*a* is the shape corresponding to the top panel part of the press formed product. The shapes of the side surfaces 11*b* are the shapes corresponding to the vertical wall parts of the press formed product. The shapes of the punch shoulder parts 11*c* are the shapes corresponding to the ridge line parts of the press formed product. A shape-changing part, which changes the shape, is formed in a part of the extending direction of the punch shoulder part 11*c*. The shape of the shape-changing part of this punch shoulder part 11*c* is the shape corresponding to the shape-changing part that exists in a part of the ridge line part of the press formed product. That is, the punch shoulder part 11*c* changes the cross-section shape in its extending direction, or includes a part where the extending direction is curved.

The first pad 13 is arranged opposed to the top surface 11*a* of the first punch 11. The first die 12 includes a concave part 12*c* at the position opposed to the top surface 11*a* of the first punch 11. The first pad 13 can be received in this concave part 12*c*. The first pad 13 constitutes a part of the first die 12 with being received in the concave part 12*c* of the first die 12. Further, the first die 12 includes corner parts 12*d* at the positions opposed to the punch shoulder parts 11*c* of the first punch 11. The shapes of these corner parts 12*d* are the shapes conforming to the punch shoulder parts 11*c*. Further, the first die 12 includes a pair of first inner side surfaces 12*a* adjacent to the corner parts 12*d*. The first inner side surfaces 12*a* are opposed to the side surfaces 11*b* of the first punch 11. The shapes of the first inner side surfaces 12*a* are the shapes corresponding to predetermined regions of the regions of the vertical wall parts of the press formed product, the predetermined regions having a predetermined height h from the top panel part. Further, the first die 12 includes a pair of second inner side surfaces 12*b* adjacent to the first inner side surfaces 12*a*. The interval between the opposing second inner side surfaces 12*b* is largely expanded outwardly in the width direction of the first die 12.

As shown in FIGS. 11A to 11D, the first pad 13 is supported by a die holder 15, which holds the first die 12, via a first pressure member 16. The first pressure member 16 is a hydraulic cylinder, a gas cylinder, a spring, a rubber, etc., and applies a downward force (a force directed to the first punch 11) to the first pad 13. In FIGS. 11A to 11D, an arm part 13*a* protrudes from the first pad 13, and the first pressure member 16 is provided between this arm part 13*a* and the die holder 15. As long as the first pad 13 is supported via the first pressure member 16, the first pad 13 may be supported by a slide that operates integrally with the first die 12 or the die holder 15.

Here, the first press forming apparatus 10 includes a pad adjusting mechanism that adjusts the distance from the top surface 11*a* of the first punch 11 to the first pad 13. The pad adjusting mechanism is constituted as follows, for example. As shown in FIGS. 11A to 11D, a block 17 is provided directly beneath the arm part 13*a* protruding from the first pad 13. This block 17 is supported by a punch holder 18, which holds the first punch 11, via a second pressure member 19. The second pressure member 19 is a hydraulic cylinder, a gas cylinder, a spring, a rubber, etc., and applies an upward force (a force directed to the first die 12) to the block 17. The upward force applied to the block 17 by the second pressure member 19 is greater than the downward force applied to the first pad 13 by the first pressure member 16. As long as the block 17 is supported via the second pressure member 19, the block 17 may be supported on a base of a pressing machine.

With the pad adjusting mechanism, as shown in FIG. 11A, the first pad 13 descends following the descending of the first die 12, and when the distance of the first pad 13 from the top surface 11*a* of the first punch 11 reaches a predetermined distance, the arm part 13*a* contacts the block 17. Thereafter, as shown in FIG. 11B, even if the descending of the first die 12 is further continued, the first pad 13 is held in the position until the first pad 13 is received in the concave part 12*c* of the first die 12. This is because the first pad 13 is subjected to the upward force from the second pressure member 19 greater than the downward force from the first pressure member 16. Then, as shown in FIGS. 11C and 11D, when the first pad 13 is received in the concave part 12*c* of the first die 12, thereafter, the first pad 13 descends integrally with the first die 12.

[Second Producing Apparatus]

As shown in FIG. 10 and FIGS. 12A to 12C, the second press forming apparatus 20 includes a main second punch 21 and a sub second punch 24 as a lower die, and includes a second die 22 and a second pad 23 as an upper die. That is, the main second punch 21 and the sub second punch 24 make a pair with the second die 22 and the second pad 23. Note that FIG. 10 shows the second die 22 by a dashed line, so as to facilitate the understanding of the structure.

The main second punch 21 includes a top surface 21*a* (a front end surface), a pair of side surfaces 21*b*, and punch shoulder parts 21*c* provided between the top surface 21*a* and the side surfaces 21*b*. The punch shoulder parts 21*c* are regions connecting the top surface 21*a* to the side surfaces 21*b*. The shape of the top surface 21*a* is the shape corresponding to the top panel part of the press formed product. The shapes of the side surfaces 21*b* are the shapes corresponding to the vertical wall parts of the press formed product. The shapes of the punch shoulder parts 21*c* are the shapes corresponding to the ridge line parts of the press formed product. A shape-changing part, which changes the shape, is formed in a part of the extending direction of the punch shoulder part 21*c*. The shape of the shape-changing part of this punch shoulder part 21*c* is the shape corresponding to the shape-changing part that exists in a part of the ridge line part of the press formed product. Further, the main second punch 21 includes curved surfaces 21*d* adjacent to its side surfaces 21*b*.

The sub second punch 24 is arranged outside of the main second punch 21 and adjacent to the main second punch 21. The sub second punch 24 includes top surfaces 24*a* (front end surfaces). The shapes of the top surfaces 24*a* are the shapes corresponding to the flange parts of the press formed product.

The second pad 23 is arranged opposed to the top surface 21*a* of the main second punch 21. The second die 22 includes a concave part 22*c* at the position opposed to the top surface 21*a* of the main second punch 21. The second pad 23 can be received in the concave part 22*c*. The second pad 23 constitutes a part of the second die 22 with being received in the concave part 22*c* of the second die 22. Further, the second die 22 includes corner parts 22*d* at the positions opposed to the punch shoulder parts 21*c* of the main second punch 21. The shapes of the corner parts 22*d* are the shapes conforming to the shapes of the punch shoulder parts 21*c*. Further, the second die 22 includes a pair of inner side surfaces 22*a* adjacent to the corner parts 22*d*. The inner side surfaces 22*a* are opposed to the side surfaces 21*b* of the main second punch 21. The shapes of the inner side surfaces 22*a* are the shapes corresponding to the vertical wall parts of the press formed product. Further, the second die 22 includes a pair of die shoulder parts 22*e* adjacent to the inner side surfaces 22*a*. The shapes of the die shoulder parts 22*e* are the shapes corresponding to the ridge line parts that exist between the vertical wall parts and the flange parts of the press formed product. Further, the second die 22 includes a pair of bottom surfaces 22*e* (front end surfaces) adjacent to the die shoulder parts 22*e*. The bottom surfaces 22*e* are opposed to the sub second punch 24.

As shown in FIGS. 12A to 12C, the second pad 23 is supported by a die holder 27, which holds the second die 22, via a third pressure member (illustration omitted). The third pressure member is a hydraulic cylinder, a gas cylinder, a spring, a rubber, etc., and applies a downward force (a force directed to the main second punch 21) to the second pad 23. As long as the second pad 23 is supported via the third pressure member, the second pad 23 may be supported by a slide that operates integrally with the second die 22 or the die holder 27.

Here, the second press forming apparatus 20 includes a sub punch adjusting mechanism that delays the pushing-in of the sub second punch 24 with respect to the second die 22 later than the pushing-in of the main second punch 21 with respect to the second die 22. The sub punch adjusting mechanism is configured, for example, as follows. As shown in FIG. 12A to 12C, the sub second punch 24 is held by a punch holder 28. The main second punch 21 protrudes from the sub second punch 24, and is supported by the punch holder 28 via a fourth pressure member 26. The fourth pressure member 26 is a hydraulic cylinder, a gas cylinder, a spring, a rubber, etc., and applies an upward force (a force directed to the second die 22) to the main second punch 21. The upward force applied to the main second punch 21 by the fourth pressure member 26 is greater than the downward force applied to the second pad 23 by the third pressure member. As long as the main second punch 21 is supported via the fourth pressure member 26, the main second punch 21 may be supported on a base of a pressing machine.

With the sub punch adjusting mechanism, as shown in FIGS. 12A and 12B, the second pad 23 is received in the concave part 22*c* of the second die 22 following the descending of the second die 22. In this manner, the pushing-in of the main second punch 21 with respect to the second die 22 is completed. Then, when the descending of the second die 22 is continued, thereafter, the main second punch 21 descends integrally with the second die 22 and the second pad 23. In this manner, the pushing-in of the sub second punch 24 with respect to the second die 22 is performed.

[Producing of Press Formed Product]

A producing method of the press formed product 7 using the above-described first press forming apparatus 10 (the first producing apparatus) and the second press forming apparatus 20 (the second producing apparatus) includes each of the following steps.

[Preparation Step]

As shown in FIG. 9 and FIG. 11A, a metal sheet 14 is prepared as a starting material. For example, a high-strength steel sheet having a tensile strength of 590 MPa or more can be used as the metal sheet 14. The metal sheet 14 may be a 980 MPa-class high-strength steel sheet, or a 1180 MPa-class high-strength steel sheet. Additionally, a stainless steel sheet, an aluminum sheet, a copper sheet, etc. may also be used as the metal sheet 14.

[First Press Working Step]

As shown in FIG. 9 and FIGS. 1A to 1D, in the first press working step, press working by bending forming is performed on the metal sheet 14 by using the first press forming apparatus 10, so as to produce an intermediate formed product 25. The intermediate formed product 25 includes a top panel part 25*a*, ridge line parts 25*b*, and vertical wall parts 25*c*. The top panel part 25*a* corresponds to the top panel part 7*a* of the press formed product 7. The ridge line parts 25*b* correspond to the ridge line parts 7*b* of the press formed product 7. The region of the vertical wall part 25*c* is segmented into a predetermined region 25*ca* leading to the ridge line part 25*b*, and an excessive region 25*cb* leading to a first vertical wall part 25*c*. The predetermined region 25*ca* corresponds to the region having a predetermined height h from the top panel part 7*a* of the region of the vertical wall part 7*c* of the press formed product 7. The excessive region 25*cb* is the region over the predetermined height h. That is, the excessive region 25*cb* is the region formed in the vertical wall part 7*c* of the press formed product 7 except for the predetermined region 25*ca*. Note that the region formed into the flange part 7*d* of the press formed product 7 is also included in the excessive region 25*cb*. Hereinafter, a specific description will be given of the statuses in the first press working step.

After placing the metal sheet 14 on the first punch 11, the first die 12 is descended. On this occasion, the arm part 13*a* is separated from the block 17, and the first pad 13 descends integrally with the first die 12. Then, as shown in FIG. 11A, the arm part 13*a* contacts the block 17. At this moment, the distance of the first pad 13 from the top surface 11*a* of the first punch 11 reaches a predetermined distance. Additionally, the second inner side surfaces 12*b* of the first die 12 contact both edges of the metal sheet 14. The descending of the first pad 13 is limited by the contact between the arm part 13*a* and the block 17.

The descending of the first die 12 is further continued. In this manner, the pushing-in of the metal sheet 14 into the first die 12 by the first punch 11 is started, and the bending forming of the metal sheet 14 is begun. On this occasion, as shown in FIG. 11B, because the descending of the first pad 13 is limited, the first pad 13 is held at the position distant from the top surface 11*a* of the first punch 11 by the predetermined distance. Therefore, the metal sheet 14 is gradually deformed to contact the first pad 13. However, the metal sheet 14 is not sandwiched between the first pad 13 and the first punch 11. That is, the metal sheet 14 is not restrained by the first pad 13 and the first punch 11.

When the descending of the first die 12 is further continued, as shown in FIG. 11C, the pushing-in of the first punch 11 with respect to the first die 12 reaches a predetermined distance short of the bottom dead point for the pushing-in. At this moment, the first pad 13 is received in the concave part 12*c* of the first die 12, and is integrated with the first die 12. That is, during the time period from when the pushing-in of the metal sheet 14 into the first die 12 by the first punch 11 is started or immediately thereafter until the pushing-in of the first punch 11 with respect to the first die 12 reaches the predetermined distance short of the bottom dead point for the pushing-in, the first pad 13 is held at the position distant from the top surface 11*a* of the first punch 11 by the predetermined distance.

Then, the first die 12 and the first pad 13 are descended, and the pushing-in of the first punch 11 with respect to the first die 12 and the first pad 13 is continued to the bottom dead point. In this manner, the top panel part 25*a* and the ridge line parts 25*b* are formed. Concurrently with this, the predetermined regions 25*ca* of the vertical wall parts 25*c* are formed. In this way, the intermediate formed product 25 is obtained. The top panel part 25*a* and the ridge line parts 25*b* of the intermediate formed product 25 match the shapes of the top panel part 7*a* and the ridge line parts 7*b* of the press formed product 7 (a part of the ridge line parts 7*b* includes the shape-changing part).

With the first press working step using the first press forming apparatus 10 as described above, the metal sheet 14 is not restrained by the first pad 13 and the first punch 11 to the bottom dead point for the pushing-in by the first punch 11 with respect to the first die 12 and the first pad 13. Therefore, during the forming, the restraining of the metal sheet by the punch and the die is alleviated. This also alleviates the tensile bending deformation in the shape-changing part and the excessive deformation/strain is suppressed. As a result, even in the case where a high-strength steel sheet is used as a starting material, it is possible to reduce the occurrence of cracks in the region of the shape-changing part.

As described above, during the forming by the first press working step, the first pad 13 is temporarily held at the position distant from the top surface 11*a* of the first punch 11 by the predetermined distance. The predetermined distance is preferably 3 mm to 30 mm. The reason is as follows. When the predetermined distance is less than 3 mm, there is a possibility that the material metal sheet is restrained. On the other hand, when the predetermined distance is more than 30 mm, the metal sheet 14 does not contact the first pad 13 during the forming, and the first pad 13 loses the reason for its existence.

Additionally, in the forming by the first press working step, the predetermined regions 25*ca*, having the predetermined height h from the top panel part 7*a*, of the region of the vertical wall parts 7*c* of the press formed product 7 are formed. The predetermined height h (mm) preferably satisfies the condition of a Formula (1) as follows.

$$Rp \leq h \leq H - Rp \quad (1)$$

Where, in the above Formula (1), H represents the height (mm) of a press formed product, and Rp represents the radius of curvature (mm) in the cross section of the ridge line part.

The radius of curvature Rp here is, in a precise sense, the radius of curvature of the inner circumference of the inner and outer circumferences of the ridge line part. That is, it corresponds to the radius of curvature of the punch shoulder part of the first punch.

Additionally, the predetermined height h may satisfy the condition of a Formula (2) as follows.

$$H/4 \leq h \leq 3 \times H/4 \quad (2)$$

[Second Press Working Step]

As shown in FIG. 10 and FIGS. 12A to 12C, in the second press working step, the press working by bending forming is performed on the intermediate formed product 25 by using the second press forming apparatus 20, so as to produce the final press formed product 7. Hereinafter, a specific description will be given of the statuses in the second press working step.

After placing the intermediate formed product 25 on the main second punch 21, the second die 22 is descended. In this manner, the second pad 23 descends integrally with the second die 22. Then, as shown in FIG. 12A, the second pad 23 contacts the top panel part 25*a* of the intermediate formed product 25. In this manner, the intermediate formed product 25 is sandwiched between the second pad 23 and the main second punch 21. Additionally, the descending of the second pad 23 is limited in the state where the intermediate formed product 25 is restrained by the second pad 23 and the main second punch 21.

The descending of the second die 22 is further continued. In this manner, the pushing-in of the intermediate formed product 25 into the second die 22 by the main second punch 21 is started, and the bending forming of the intermediate formed product 25 is begun.

When the descending of the second die 22 is further continued, as shown in FIG. 12B, the pushing-in by the main second punch 21 with respect to the second die 22 reaches the bottom dead point for the pushing-in. On this occasion, the second pad 23 is received in the concave part 22*c* of the second die 22, and is integrated with the second die 22. At the same time, the main second punch 21 is integrated with the second die 22 and the second pad 23. In this manner, the top panel part 7*a* and the ridge line parts 7*b* of the press formed product 7 are completely formed. Further, the regions of the vertical wall parts 7*c* of the press formed product 7 are completely formed from the predetermined regions 25*ca* of the intermediate formed product 25, and from the excessive regions 25*cb* of the intermediate formed product 25.

The descending of the second die 22 and the second pad 23 is further continued. In this manner, the pushing-in of the intermediate formed product 25 into the second die 22 and the second pad 23 by the sub second punch 24 is started. Then, the second die 22 and the second pad 23 are descended, and the pushing-in of the sub second punch 24 with respect to the second die 22 and the second pad 23 is continued to the bottom dead point. In this manner, the flange parts 7*d* are formed from the excessive regions 25*cb* of the intermediate formed product 25. In this way, the press formed product 7 is obtained.

With the second press working step using the second press forming apparatus 20 as described above, the forming of the flange parts is performed lastly. In this manner, it is possible to reduce the warping of the vertical wall parts generated due to springback. That is, the shape fixability is improved.

Accordingly, even in the case where the press formed product having a relatively complex shape is produced, it is possible to expedite the increasing of the strength, and it is also possible to increase the degree of freedom in designing.

[Press Formed Product]

Figure 1:
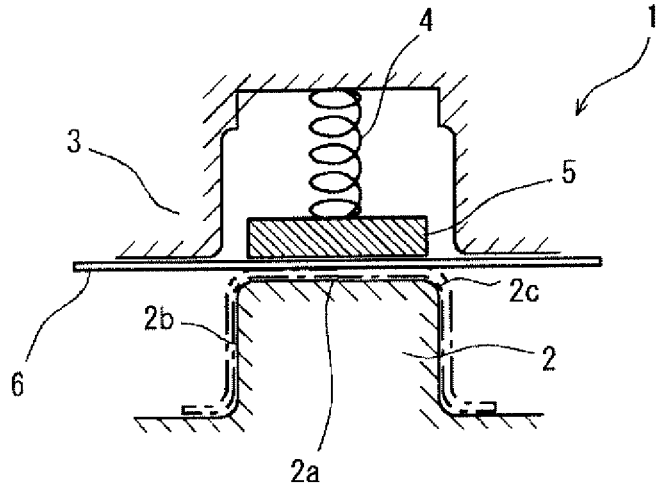
FIG. 1 is a cross-sectional view schematically showing an exemplary structure of a press forming apparatus performing general bending forming.
Figure 2A:
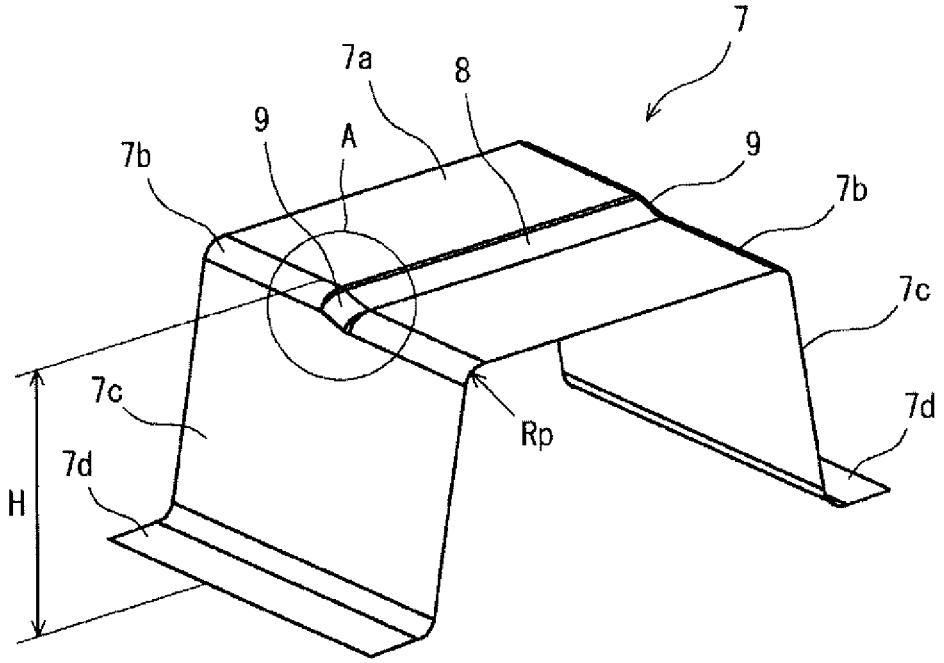
FIG. 2A is a perspective view showing an example of a press formed product having a relatively complex shape.
Figure 2B:
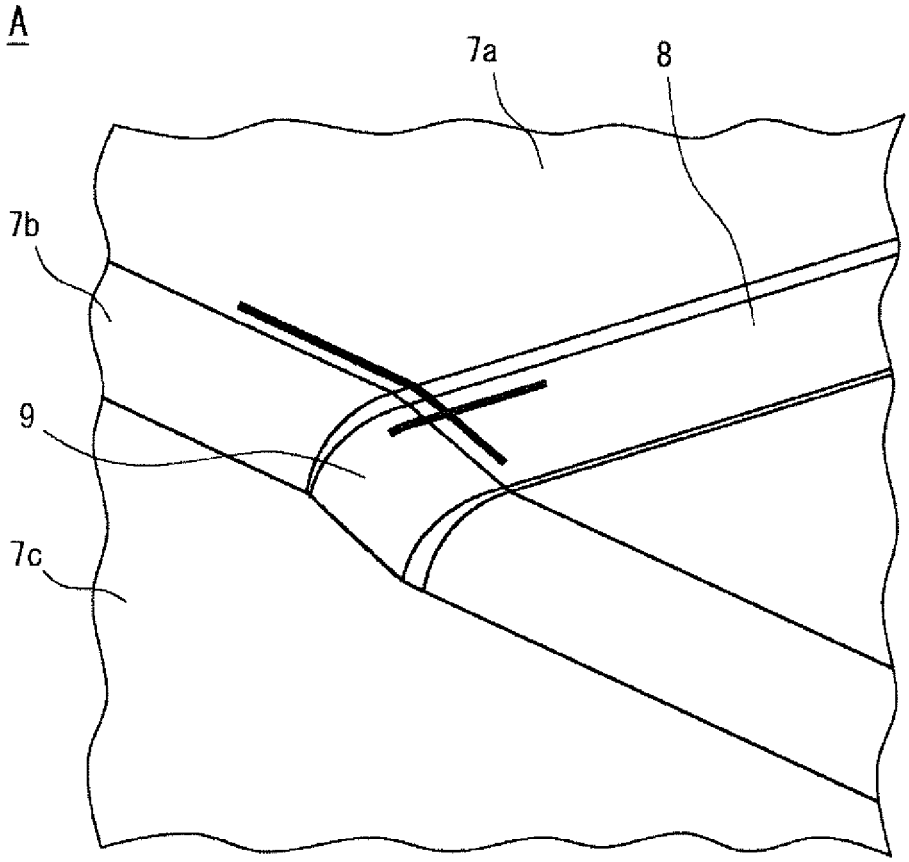
FIG. 2B is a perspective view showing a part A in FIG. 2A in an enlarged manner.
Figure 3:
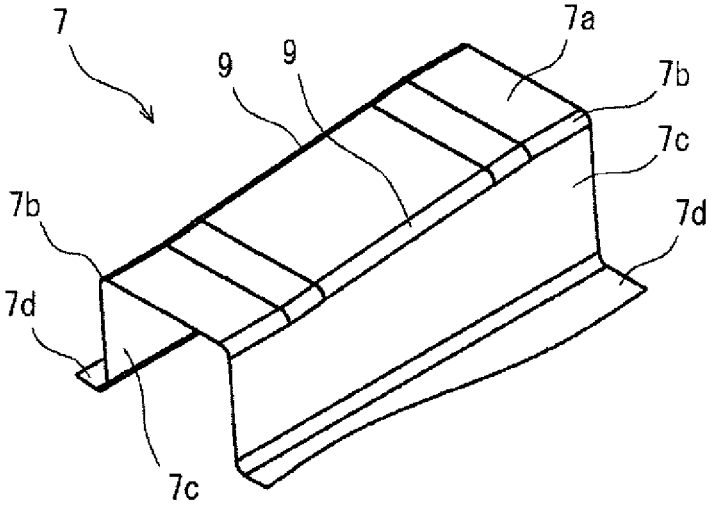
FIG. 3 is a perspective view showing an example of a press formed product having a relatively complex shape.
Figure 4:
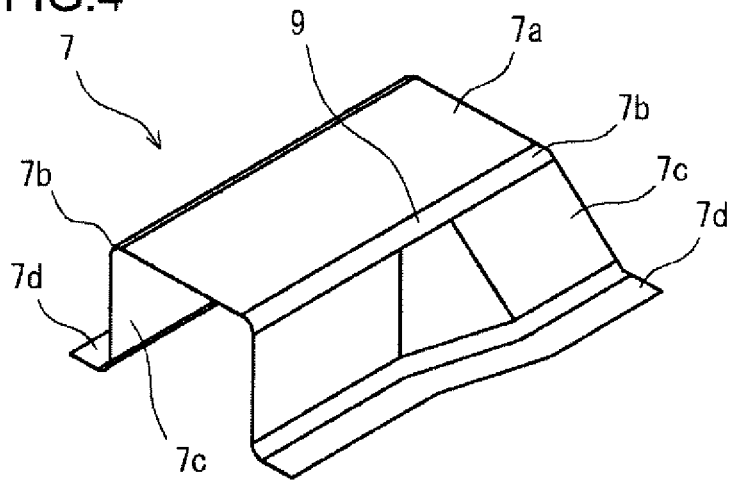
FIG. 4 is a perspective view showing an example of a press formed product having a relatively complex shape.
Figure 5:
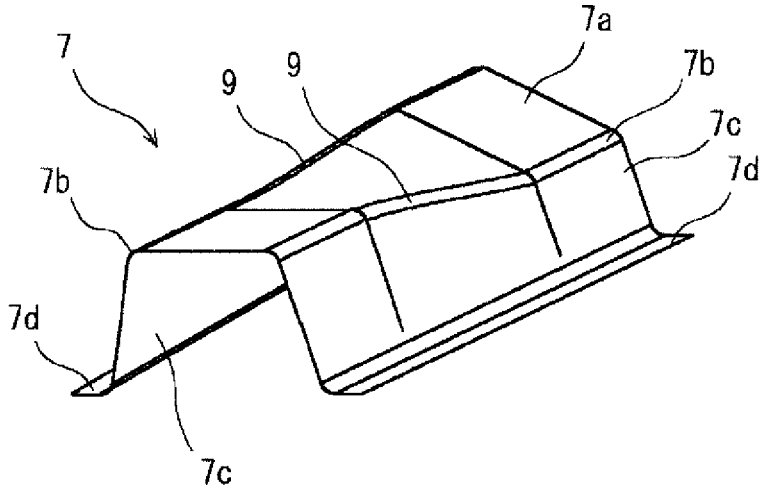
FIG. 5 is a perspective view showing an example of a press formed product having a relatively complex shape.
Figure 6:
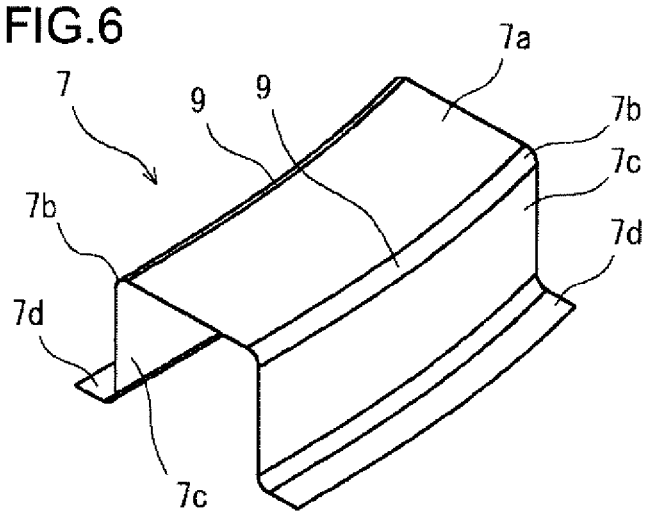
FIG. 6 is a perspective view showing an example of a press formed product having a relatively complex shape.
Figure 7:
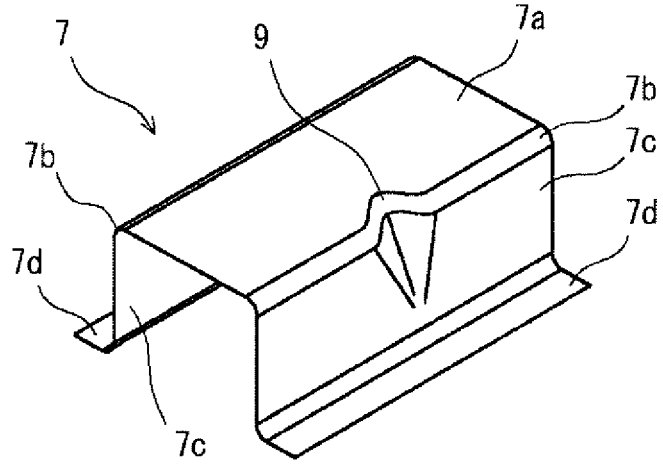
FIG. 7 is a perspective view showing an example of a press formed product having a relatively complex shape.
Figure 8:
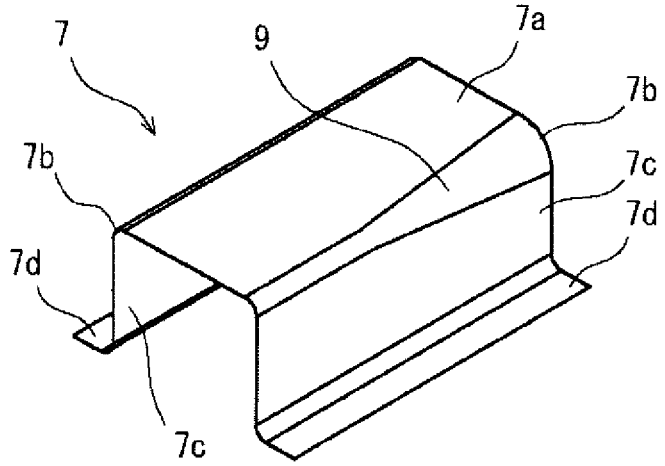
FIG. 8 is a perspective view showing an example of a press formed product having a relatively complex shape.

The first exemplary press formed product 7, having the hat-shaped cross-section shown in the above-described FIG. 2A, was produced according to the producing method of the first embodiment. A 590 MPa-class high-strength steel sheet was used as the starting material. In this press formed product 7, a crack did not occur in the regions of the shape-changing parts 9.

Additionally, the maximum principle strain in the regions of the shape-changing parts 9 was studied. In the press formed product 7 according to the first embodiment, the maximum principle strain was 0.22. On the other hand, in the press formed product 7 by the pad bending forming shown in the above-described FIG. 1, the maximum principle strain was as high as 0.26.

Additionally, the amount of warping of the vertical wall parts 7*c* was studied. The interval between the lower ends of the pair of vertical wall parts 7*c* was evaluated as the amount of warping. The amount of warping in the press formed product 7 according to the first embodiment was reduced to about 13%, compared to the amount of warping in the press formed product by the pad bending forming shown in the above-described FIG. 1.

The press formed product to be produced in the first embodiment is not limited to the first exemplary press formed product 7 having the hat-shaped cross-section shown in FIG. 2A. That is, the press formed product may be the second to seventh exemplary press formed products 7 shown in the above-described FIGS. 3 to 8, as long as a part of the ridge line part includes a shape-changing part. In short, the shape-changing part of the ridge line part of the press formed product is at least one of (a) to (f) as follows:

(a) the height of the ridge line part is changed;

(b) the arc length in the cross section of the ridge line part is changed;

(c) the ridge line part is twisted;

(d) the ridge line part is bent in the width direction;

(e) the ridge line part protrudes or is hollowed in the width direction; and (f) the radius of curvature in the cross section of the ridge line part is changed.

Note that, in the second to seventh exemplary press formed products 7 shown in the above-described FIGS. 3 to 8, a wrinkle is likely to be generated in the regions of the shape-changing parts 9 and in the region in the vicinity thereof. According to the first embodiment, it is also possible to suppress such a wrinkle.

Additionally, the pair of ridge line parts of the press formed product does not have to be parallel. For example, a pair of ridge line parts may be crossed at their ends.

Second Embodiment

A second embodiment is based on the first embodiment, and modifies a part of the first embodiment. When the main objective is to reduce a crack in the region of the shape-changing part, the second press working step by the above-described second press forming apparatus can be omitted. In this case, as for the first die 12 shown in FIG. 9 and FIGS. 11A to 11D, the second inner side surfaces 12*b* are omitted, and the first inner side surfaces 12*a*, having the shapes corresponding to the vertical wall parts 7*c* of the press formed product 7, are extended to the regions of the second inner side surfaces 12*b*. In this manner, the final press formed product is formed in the first press working step by the above-described first press forming apparatus. The second embodiment can be applied to the producing of the press formed product whose height is not so high, and especially, it can be applied to the producing of the press formed product having a channel cross-section without flange parts.

Third Embodiment

A third embodiment is based on the first embodiment, and modifies a part of the first embodiment. When the main objective is to reduce a crack in the region of the shape-changing part as in the above-described second embodiment, in the above-described second press working step, a simple pad bending forming may be performed on the intermediate formed product, or the bending forming without a pad may be performed on the intermediate formed product.

Fourth Embodiment

A fourth embodiment is based on the first embodiment, and modifies a part of the first embodiment. When the main objective is to reduce the warping of the vertical wall parts, the first press working step by the above-described first press forming apparatus can be omitted. In this case, in the second press working step by the above-described second press forming apparatus, a metal sheet is used as the starting material, and the final press formed product is formed. Additionally, a preliminary press working step instead of the first press working step can be introduced, and the above-described intermediate formed product can be formed in this preliminary press working step. In the preliminary press working step, a simple pad bending forming may be performed on a metal sheet.

Also, needless to say, the present invention is not limited to the above-described embodiments, and various modifications can be made without departing from the spirit of the present invention. For example, though the first press forming apparatus of the above-described embodiments has the structure that includes the first punch as the lower die, and includes the first die and the first pad as the upper die, the first press forming apparatus of the above-described embodiments may have the structure in which the arrangement of the upper and lower dies is inverted. Although the second press forming apparatus of the above-described embodiments has the structure that includes the main second punch and the sub second punch as the lower die, and includes the second die and the second pad as the upper die, the second press forming apparatus of the above-described embodiments may have the structure in which the arrangement of the upper and lower dies is inverted.

Additionally, the first pad of the first press forming apparatus is preferably arranged opposed to the front end surface of the first punch, at least in the cross section that is perpendicular to the extending direction of the punch shoulder part in the shape-changing part. That is, the first pad is preferably provided at the position that at least overlaps the shape-changing part in the ridge line part of the press formed product. However, it is not necessary for the first pad to be provided at the position that overlaps the shape-changing part in the ridge line part of the press formed product. That is, the first pad may be provided at the position that overlaps with a vicinity part, if the vicinity part is within 100 mm from the shape-changing part in the ridge line part of the press formed product.

REFERENCE SIGNS LIST

7: press formed product, 7*a*: top panel part, 7*b*: ridge line part, 7*c*: vertical wall part,
7*d*: flange part,
8: step height part, 9: shape-changing part,
10: first press forming apparatus,
11: first punch, 11*a*: front end surface, 11*b*: side surface.
11*c*: punch shoulder part,
13: first pad, 13*a*: arm part,
12: first die, 12*a*: first inner side surface, 12*b*: second inner side surface,
12*c*: concave part, 12*d*: corner part,
14: starting material (metal sheet), 15: die holder,
16: first pressure member, 17: block,
18: punch holder, 19: second pressure member,
20: second press forming apparatus,
21: main second punch, 21*a*: front end surface, 21*b*: side surface,
21*c*: punch shoulder part, 21*d*: curved surface,
22: second die, 22*a*: inner side surface, 22*c*: concave part,
22*d*: corner part, 22*e*: die shoulder part, 22*f*: front end surface,

23: second pad,
24: sub second punch, 24*a*: top surface,
25: intermediate formed product,
25*a*: top panel part, 25*b*: ridge line part, 25*c*: vertical wall part,
25*ca*: predetermined region, 25*cb*: excessive region
26: fourth pressure member, 27: die holder, 28: punch holder

The invention claimed is:

1. A method for producing a press formed product from a starting material, the press formed product comprising a top panel part, vertical wall parts respectively extending from both ends of the top panel part, and ridge line parts between the vertical wall parts and the top panel part, and including a shape-changing part in a part of the ridge line parts, the producing method comprising:

a preparation step of preparing a metal sheet as the starting material; and a press working step of performing press working on the starting material by using a punch, a pad arranged opposed to a front end surface of the punch, and a die capable of receiving the pad, the press working step including:

during a time period from when pushing-in of the starting material into the die by the punch is started or immediately thereafter until the pushing-in of the punch with respect to the die reaches a predetermined distance short of a bottom dead point for the pushing-in, holding the pad at a position distant from the punch by the predetermined distance;

when the pushing-in of the punch with respect to the die reaches the predetermined distance short of the bottom dead point, receiving the pad in the die; and continuing the pushing-in of the punch with respect to the die and the pad to the bottom dead point, so as to form the top panel part, the ridge line parts, and the vertical wall parts;

wherein, in the press working step, the top panel part and the ridge line parts are formed, and predetermined regions, having a predetermined height from the top panel part, of regions formed into the vertical wall parts are also formed, the producing method further comprises a second press working step of performing press working on an intermediate formed product obtained in the press working step, and in the second press working step, the vertical wall parts are formed from excessive regions of the regions formed into the vertical wall parts except for the predetermined regions.

2. The producing method of the press formed product according to claim 1, wherein the predetermined distance is 3 mm to 30 mm.

3. The producing method of the press formed product according to claim 1, wherein the press formed product further comprises flange parts extending from ends of the respective vertical wall parts, the second press working step uses a main second punch, a sub second punch arranged adjacent to the main second punch, a second pad arranged opposed to a front end surface of the main second punch, and a second die capable of receiving the second pad, and includes:

a step of starting pushing-in of the intermediate formed product into the second die by the main second punch, with the top panel part of the intermediate formed product being sandwiched between the main second punch and the second pad;

a step of continuing the pushing-in of the main second punch with respect to the second die to a bottom dead point for the pushing-in, so as to receive the second pad in the second die, and to form the vertical wall parts from the excessive regions of the intermediate formed product; and a step of starting the pushing-in of the sub second punch with respect to the second die and the second pad, and continuing the pushing-in of the sub second punch to the bottom dead point for the pushing-in, so as to form the flange parts from the excessive regions of the intermediate formed product.

4. The producing method of the press formed product according to claim 1, wherein the predetermined height h (mm) satisfies the condition of a Formula (1) as follows:

$$Rp \leq h \leq H - Rp \quad (1)$$

where, in the Formula (1), H represents the height (mm) of the press formed product, and Rp represents the radius of curvature (mm) in a cross section of the ridge line part.

5. The producing method of the press formed product according to claim 1, wherein the shape-changing part of the ridge line parts is at least one of (a) to (f) as follows:

(a) the height of the ridge line part is changed;

(b) the arc length in the cross section of the ridge line part is changed;

(c) the ridge line part is twisted;

(d) the ridge line part is bent in the width direction;

(e) the ridge line part protrudes or is hollowed in the width direction; and (f) the radius of curvature in the cross section of the ridge line part is changed.

* * * * *